United States Patent [19]

Herbst et al.

[11] 4,096,872

[45] Jun. 27, 1978

[54] HEAT SHIELDING STRUCTURE FOR DISHWASHERS

[75] Inventors: LeRoy J. Herbst; Thomas E. Jenkins, both of Louisville, Ky.

[73] Assignee: General Electric Company, Louisville, Ky.

[21] Appl. No.: 774,208

[22] Filed: Mar. 3, 1977

[51] Int. Cl.[2] ..... B08B 3/02; B08B 13/00

[52] U.S. Cl. ..... 134/105; 134/182; 134/201; 34/73

[58] Field of Search ..... 134/104–108, 134/154, 182–183, 201; 34/73, 134

[56] References Cited

U.S. PATENT DOCUMENTS

| | | | |
|---|---|---|---|
| 3,049,133 | 8/1962 | Jacobs | 134/108 X |
| 3,049,136 | 8/1962 | Van Scoyk | 134/183 X |
| 3,049,450 | 8/1962 | Koons et al. | 134/105 X |
| 3,130,737 | 4/1964 | Jellies | 134/107 X |
| 3,555,242 | 1/1971 | Jenkins et al. | 134/108 X |

FOREIGN PATENT DOCUMENTS

| | | | |
|---|---|---|---|
| 1,403,641 | 10/1968 | Germany | 134/107 |
| 2,063,288 | 6/1972 | Germany | 134/105 |

*Primary Examiner*—Robert L. Bleutge
*Attorney, Agent, or Firm*—Bruce A. Yungman; Francis H. Boos

[57] ABSTRACT

A dishwasher is disclosed which includes a tub formed of plastic, such as polypropylene, or other heat-deformable material. A heating element for effecting the final drying of the articles in the dishwasher is disposed near the bottom wall of the tub where the heat from the heating element could cause a deformation of the adjacent portion of the bottom wall of the tub. A shallow receptacle is disposed between the heating element and the portion of the bottom wall of the tub in close proximity thereto. The receptacle retains a small amount of the water used in the washing and rinsing operations and the evaporation of this water during the energization of the heating element insures that the temperature of the adjacent bottom wall remains below that at which any damage thereto could occur. Spaced dividers extending transversely of the slope of the bottom wall are provided in the receptacle to insure that water is retained therein over substantially the entire surface of the bottom of the receptacle.

8 Claims, 4 Drawing Figures

HEAT SHIELDING STRUCTURE FOR DISHWASHERS

BACKGROUND OF THE INVENTION

This invention relates generally to dishwashers and more particularly to an arrangement for preventing damage to components thereof positioned near a heating element employed therein.

Some present day dishwashers have tubs made of plastic or other material which may be deformed by heat. These dishwashers also usually have a sheath-type heating element near the bottom of the tub for effecting the complete drying of articles washed in the dishwasher. To allow the maximum space for dish-supporting racks, the heating element must be mounted reasonably close to the bottom wall of the tub. The problem with such disposition of the heating element is that it may overheat those dishwasher components, made of plastic or other heat deformable material, which are disposed in the vicinity of the heating element, particularly adjacent portions of the bottom wall of the tub. The heat from the heating element during the drying cycle may, particularly over a period of time, cause serious deformation of the adjacent portion of the bottom of the tub or other components in the vicinity of the heating element, this deformation ultimately being of such an extent as to require replacement of the deformed parts.

By the present invention this problem of the prior art is overcome and the possibility of damage to heat deformable components is eliminated. Moreover, this is accomplished with minimal change in the dishwasher and at minimal added cost.

Accordingly, it is an object of the present invention to provide a heat shielding structure for a dishwasher which prevents overheating of components positioned in close proximity to the heating element of the dishwasher.

It is another object of this invention to provide a heat shielding structure for a dishwasher which insures that components near the heating element are maintained at a temperature below that which could cause deformation of such components.

It is still another object of this invention to provide heat shielding structure for a dishwasher which can be economically manufactured.

SUMMARY OF THE INVENTION

In carrying out the invention in one form thereof, a dishwasher is constructed in a conventional manner to include a tube formed of plastic, such as polypropylene or other heat-deformable material, and racks for supporting articles to be washed are mounted within the tub. A heating element for effecting the final drying of the articles in the dishwasher is disposed near the bottom wall of the tub where the heat from the heating element could cause a deformation of the adjacent portion of the bottom wall of the tub or other component disposed in the vicinity of the heating element. In accordance with this invention, in the particular form illustrated, a shallow receptacle is disposed between the heating element and a portion of the bottom wall of the tub in close proximity thereto. The receptacle retains a small amount of the water used in the washing and rinsing operations and the evaporation of this water during the energization of the heating element insures that the temperature of the adjacent bottom wall remains below that at which any damage thereto could occur. Spaced dividers extending transversely of the slope of the bottom wall are provided in the receptable to insure that water is retained therein over substantially the entire surface of the bottom of the receptacle.

DESCRIPTION OF THE DRAWINGS

For a better understanding of the invention, reference may be made to the accompanying drawings in which.

DESCRIPTION OF THE PREFERRED EMBODIMENT

Figure 1:
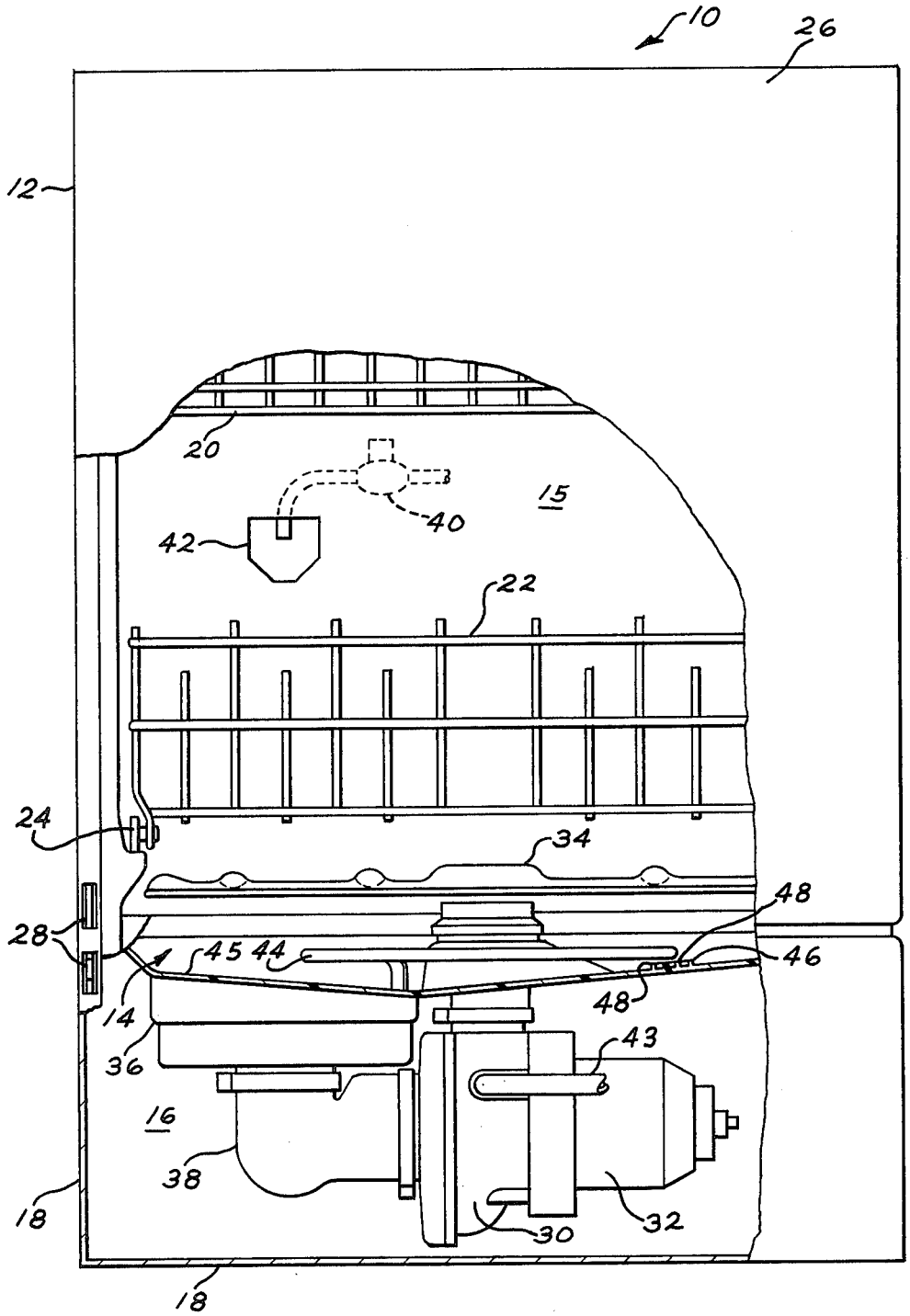
FIG. 1 is a front view, partly broken away, of a dishwasher incorporating the heat shielding structure of this invention.

Referring now to the drawings, there is shown a dishwasher 10 which includes an outer cabinet 12. The cabinet includes a tub 14 which forms the washing compartment 15 and a machinery compartment 16. The walls 18 of the machinery compartment are formed of metal. The tub 14 is formed as a one-piece structure of a plastic or other heat-deformable material, such as polypropylene, and is supported on the side walls 18 of the machinery compartment.

Racks 20 and 22 for supporting articles to be washed are mounted within the tub 14. The racks are mounted on rollers, one of which is shown at 24, for permitting the racks to be pulled outwardly of the cabinet to facilitate loading of articles therein. A door 26 is provided for obtaining access to the interior of the cabinet and the racks mounted therein. The door is supported on hinges (not shown) which extend through slots 28 in the cabinet.

In the machinery compartment 18, there is disposed a pump 30 which is driven by an electric motor 32. The pump is connected by a conduit (not shown) to supply water to reaction-type spray arm 34 which is arranged to eject a spray of washing or rinsing fluid over the articles in the dishwasher in a conventional manner. Water flows to a sump 36 from which it is returned to the pump through a conduit 38. Water for operation of the dishwasher is supplied as needed from a regular household water line, indicated at 40. The water is delivered into a fill funnel 42 from which it overflows into the tub and collects in the bottom of the tub. The pump then circulates the water through the spray arm and back through the sump for a period of time sufficient to adequately wash and rinse the articles in the dishwasher. After each washing or rinsing operation is completed the water is discharged by the pump through a conduit 43.

While articles may be dried by merely circulating air thereover, dishwashers are frequently provided with a heating element for insuring complete drying of the articles washed therein. This heating element, indicated at 44 in the drawing, is positioned near the bottom wall 45 of the dishwasher and air heated thereby flows upwardly to effect drying of the articles in the dishwasher. The heating element is conventionally of the sheathed type, such as that sold under the trademark Calrod. Since it is desirable to provide as much space as possible for the racks in which the articles to be washed are placed and since the spray arm 34 must be provided beneath the racks, it is necessary to position the heating element relatively closely to the bottom wall 45 of the tub. Where the bottom wall is formed of plastic or other heat-deformable material, such as polypropylene, the necessity of placing the heating element relatively close thereto creates a problem; namely, it introduces a risk that the bottom wall, or other component disposed in the vicinity of the heating element, may become deformed by the heat from the heating element.

In accordance with this invention, such damage to and deformation of the bottom wall of the tub or other component is eliminated by providing between the heating element and the portion of the bottom wall or other component adjacent thereto a receptacle 46 which catches and retains some of the water employed in the dishwashing operation. Thus, the water in the receptacle is disposed, in the form of the invention illustrated, between the heating element and the bottom wall of the tub. When the heating element 44 is energized, this water effectively prevents a temperature rise of the bottom wall which could be sufficient to cause any deformation of the plastic or other heat-deformable material of which this wall is formed. The heat from the heating element effects evaporation of the water in the receptacle and this evaporation insures that the receptacle and the bottom wall of the tub adjacent thereto do not reach an excessively high temperature.

The receptacle is shallow, being only about 0.1 to 0.15 inch in depth so that only a limited amount of water is retained therein. This water is essentially all evaporated during the drying operation, that is, during the time the heating element is energized and by residual heat after the heating element is de-energized, and has no adverse effect on the complete drying of the articles in the dishwasher. Moreover, because of the shallow depth of the receptacle, food particles washed from the articles do not collect therein but are discharged from the sump in the normal manner.

Figure 2:
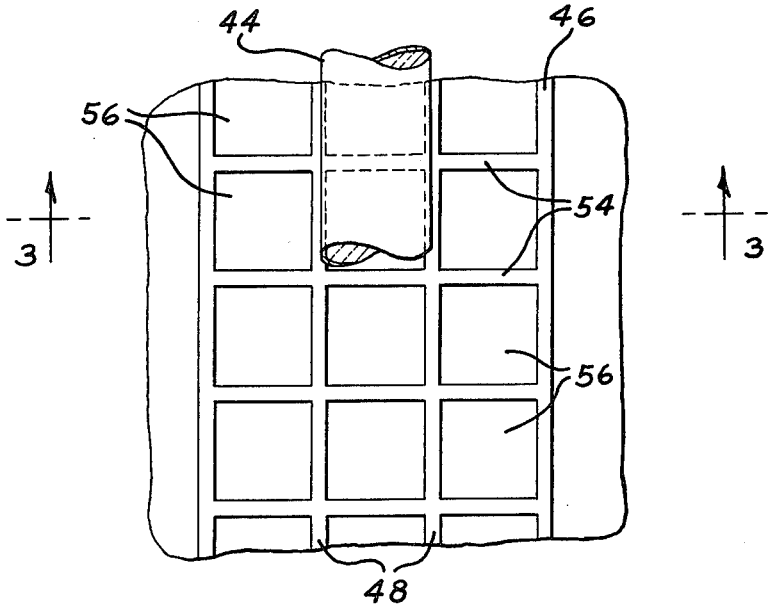
FIG. 2 is an enlarged top view of the heat shielding structure shown in FIG. 1.
Figure 3:
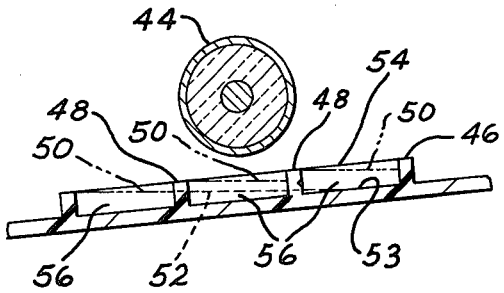
FIG. 3 is a sectional view taken along the line 3—3 in FIG. 2.

In order to insure that water in the dishwasher tub flows to the sump for recirculation by the pump and ultimately for discharge from the dishwasher by the pump, the bottom wall of the tub is normally provided with a slight slope to direct the water to the sump. In order to insure that, despite this slope and the shallow depth of the receptacle, water is retained in the receptacle over substantially the entire area of the receptacle, and therefore over essentially the entire adjoining surface of the bottom wall, spaced members or dividers are provided in the receptacle as shown in FIGS. 2 and 3. In the form of the invention shown, a plurality of spaced dividers 48 extending transversely of the slope of the bottom wall 45 are employed. The dividers insure that, despite the slope, water is retained over substantially the entire bottom surface of the receptacle.

This can be best understood by referring to FIG. 3 which illustrates, by the dashed lines 50, the level of water in each of the compartments formed by the dividers 48. Were the dividers not present, the level of the water collecting in the receptacle would be indicated by the dotted line 52. By comparing the top surface of the water in the receptacle, as indicated by the numerals 50 and by the numeral 52, it can be readily appreciated that with the structure of this invention the water extends over the entire surface whereas, without the utilization of the transverse dividers, the water would extend over only a portion of the surface, leaving the remainder, indicated by the numeral 53, and hence the adjoining bottom wall of the tub, fully exposed to the heat from the heating element. Moreover, the condition illustrated in FIG. 3 is that existing at the time the heating element 44 is first energized. During the period of energization of the heating element, some of the water would be evaporated, leaving an even greater area 53 directly exposed to the heat from the heating element. With the dividers employed in the heat shielding structure of this invention, water will cover substantially the entire bottom surface even after some evaporation has taken place.

Since the bottom wall of the tub may slope in more than one direction, in the specific form of the invention shown, not only are the transverse dividers 48 employed but also spaced members or dividers 54 extending transversely of the dividers 48 and forming therewith a plurality of rectangular compartments 56 for retention of water. In a situation where the slope is entirely in one direction, only one set of dividers, these extending transversely of the slope, would be required, since the purpose is to prevent all of the water in the receptacle from collecting on the downhill side and thereby failing to cover a portion of the bottom of the receptacle at the uphill side thereof. Where there is slope only in the direction shown in FIG. 3, for example, the additional dividers 54 would not be essential, because there would be no tendency for the water to flow to one end or the other of compartments formed by dividers 48 alone. However, even where a portion of the bottom slopes in only one direction, as manufactured, it may be desirable to employ a criss-cross divider structure, as shown in FIG. 2, because the dishwasher may not be precisely level when installed. Also, forming small compartments by use of both dividers 48 and dividers 54, as shown in FIG. 2, better insures that adequate water is retained despite the very shallow depth of the receptacle, even if water surges across the receptacle in discharging from the dishwasher.

Figure 4:
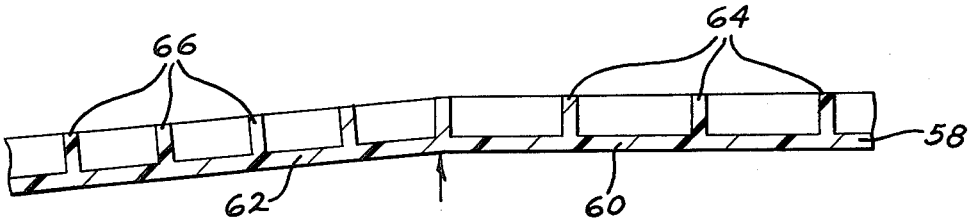
FIG. 4 is a sectional view of a heat shielding structure employed where two different slopes are involved.

The spacing of the dividers necessary to insure that water is retained over the entire surface of the receptacle is dependent upon the slope of the bottom wall. The greater the slope the more closely the dividers must be spaced in order to insure, with the relatively shallow receptacle employed, that water is retained over substantially the entire surface during the time the heating element is operating. Thus, the spacing of the dividers for optimum performance of the heat shielding structure of this invention is inversely proportional to the slope. The relationship between the slope of the surface on which the receptacle is disposed and the spacing of the dividers extending transversely of this slope is best illustrated in FIG. 4. This figure illustrates a receptacle 58 having a first portion 60 disposed on a surface having a relatively gentle slope and a second portion 62 disposed on a surface having a steeper slope. Dividers 64 extending transversely of the slope are arranged in the first portion 60 of the receptacle. These dividers are spaced relatively widely because of the gentle slope. In the portion 62 which has a steeper slope, the dividers 66, also extending transversely of that slope, are spaced more closely together than dividers 64. Since the surface of the water, of course, assumes a horizontal position in all cases, it can be readily understood that the greater the slope the more closely the dividers must be spaced in order to insure that water adequately covers the entire bottom of the receptacle. Or, in other words, the spacing of the dividers extending transversely of the slope is generally inversely proportional to the slope.

The receptacle may be separately formed and mounted on the bottom wall of the dishwasher. Preferably, however, as in the form of the invention shown, the upwardly extending receptacle walls and the dividers are molded from the plastic material, such as polypropylene, integrally with the bottom wall of the tub, the receptacle and dividers being formed in the same operation during which the tub is formed. Thus, only a minimal cost is added to the normal cost of a dishwasher not incorporating this invention.

While the invention has been specifically described as applied to protection of the bottom wall of a plastic dishwasher tub, it will be apparent that it could be used also to protect other heat-deformable components disposed in the vicinity of the heating element. Further, while a particular structure has been shown and described, it will be understood that the invention is not limited to this particular structure and it is intended by the appended claims to cover all modifications which come within the spirit and scope of this invention.

What is claimed as new and desired to be secured by Letters Patent of the United States is:

1. In a dishwasher including a tub formed of a material subject to deformation under heat, said tub including a sloping bottom wall, and a heating element for drying article placed in said tub, said heater being in relatively close spaced relationship with a portion of said bottom wall, a heat shielding structure for preventing deformation of said bottom wall under heat from said heating element during the drying operation comprising a shallow receptacle disposed on said bottom wall between said heater and said bottom wall for collecting a small quantity of the water employed in the washing operation.

2. The heat shielding structure of claim 1, further comprising means for dividing said receptacle into a plurality of smaller compartments.

3. The heat shielding structure of claim 2, said means comprising first spaced members extending across said receptacle in a direction substantially transverse to the slope of the bottom wall to insure retention of water in said compartments over substantially the entire area of said receptacle.

4. The heat shielding structure as recited in claim 3 wherein the distance between said first spaced members is inversely proportional to the slope of the bottom wall.

5. The heat shielding structure as recited in claim 3 further comprising second spaced members extending substantially transversely of said first spaced members to provide a plurality of substantially rectangular compartments.

6. The heat shielding structure as recited in claim 5 wherein the distance between said second spaced members is inversely proportional to the slope of the bottom wall.

7. The heat shielding structure as recited in claim 2 wherein said receptacle and said dividing means are formed integrally with said bottom wall.

8. The heat shielding structure as recited in claim 7 wherein said receptacle, said dividing means and said tub are made of polypropylene.

* * * * *